US008485916B2

(12) United States Patent
Gill et al.

(10) Patent No.: US 8,485,916 B2
(45) Date of Patent: Jul. 16, 2013

(54) APPARATUS AND METHOD FOR FORMING A REMINDER RIB IN A GRIP

(75) Inventors: David Keith Gill, Pinehurst, NC (US); Alex Lee Walls, Laurinburg, NC (US)

(73) Assignee: Eaton, Cleveland, OH (US)

( * ) Notice: Subject to any disclaimer, the term of this patent is extended or adjusted under 35 U.S.C. 154(b) by 470 days.

(21) Appl. No.: 12/470,578

(22) Filed: May 22, 2009

(65) Prior Publication Data

US 2010/0298063 A1 Nov. 25, 2010

(51) Int. Cl.
*A63B 53/14* (2006.01)

(52) U.S. Cl.
USPC ..... 473/303

(58) Field of Classification Search
USPC ..... 473/303
See application file for complete search history.

(56) References Cited

U.S. PATENT DOCUMENTS

| | | | | |
|---|---|---|---|---|
| 2,103,889 | A * | 12/1937 | Brisick | 473/303 |
| 2,166,044 | A | 7/1939 | Lewthwaite | 473/551 |
| 2,437,404 | A | 3/1948 | Robinson | 473/203 |
| 2,871,899 | A | 2/1959 | Coyle et al | |
| 3,706,453 | A | 12/1972 | Rosasco, Jr. | 473/203 |
| 3,877,959 | A | 4/1975 | Weiss | 427/172 |
| 4,681,317 | A | 7/1987 | Brandell | 482/126 |
| 5,123,646 | A | 6/1992 | Overby et al. | 473/298 |
| 5,281,288 | A | 1/1994 | Murray et al. | 156/83 |
| 5,364,677 | A | 11/1994 | Sendziak | 428/40.1 |
| 5,575,724 | A | 11/1996 | Hannon et al. | |
| 5,584,482 | A | 12/1996 | Huang | 473/301 |
| 5,660,922 | A | 8/1997 | Herridge et al. | 428/214 |
| 6,060,160 | A | 5/2000 | Fontanilla | 428/346 |
| 6,074,745 | A | 6/2000 | Speeney | 428/343 |
| 7,637,821 | B2 * | 12/2009 | Johnson | 473/202 |
| 2002/0041956 | A1 | 4/2002 | Nojiri | 428/343 |
| 2003/0228929 | A1 | 12/2003 | Miyasu et al. | 473/300 |
| 2006/0068148 | A1 | 3/2006 | Ulrich | |
| 2006/0287124 | A1 | 12/2006 | Han et al. | |
| 2008/0102974 | A1 * | 5/2008 | Nam et al. | 473/300 |
| 2009/0253530 | A1 | 10/2009 | Sugimae | |

OTHER PUBLICATIONS

European Search Report dated Aug. 23, 2010 for European Patent Application No. 10005366.9-2318.
U.S. Appl. No. 10/950,836, filed Sep. 27, 2004, James Jay Ulrich.

* cited by examiner

*Primary Examiner* — Michael Dennis
(74) *Attorney, Agent, or Firm* — Daniel S. Kalka

(57) ABSTRACT

An apparatus and method for forming a reminder rib on a hand grip using an improved core bar having an axial groove extending lengthwise on a molding portion of the core bar for forming a rib on an interior surface of the hand grip. When the hand grip is installed on a shaft or handle, the interior rib forms a reminder rib on an underside of the hand grip.

2 Claims, 7 Drawing Sheets

APPARATUS AND METHOD FOR FORMING A REMINDER RIB IN A GRIP

BACKGROUND

The present disclosure relates to an apparatus and method for forming a reminder rib in a grip, and more particularly to a reminder rib in a golf club grip.

While some golfers and club makers prefer to use a grip that is simply round, or circular in cross-section, there are those who do prefer a grip with the reminder rib. The golf grip manufacturers and suppliers try to accommodate customers in both of these market segments by making and stocking grip models in both forms. One form has the round core or wall section. The other form has a ribbed core or one formed by an inner wall with a flat on one side to cause the protruding slightly raised rib once the grip is installed on the club shaft. Manufacturing and maintaining an inventory of these two separate grip models adds complexity and costs to the golf grip manufacturers and suppliers businesses.

BRIEF SUMMARY

The present disclosure provides a method for forming a grip with a reminder rib. The grip is molded on a core bar or mandrel that has an axial groove of a selected depth and length. As the elastomeric material is molded on and around the core bar, the grip is formed with a rib extending axially in the interior of the grip.

The present disclosure is also directed to the apparatus for forming a grip with a reminder rib. Sleeves constructed to fit on a core bar of a compression mold have an axial groove of a selected depth and length disposed axially on the sleeve. When the sleeve is placed on the core bar and an elastomeric material molded thereon, the completed grip has a reminder rib situated axially in the interior of the grip.

The present disclosure is further directed to an improved core bar constructed for use in a mold with the core bar having an axial groove with a selected depth and length axially disposed therein.

DETAILED DESCRIPTION

Figure 1:
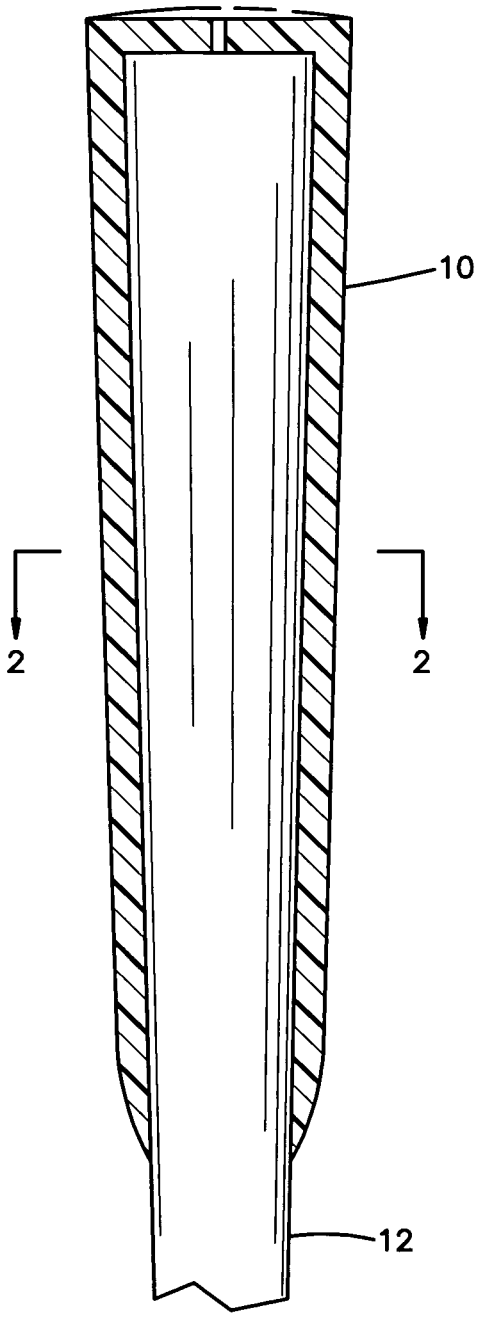
FIG. 1 is a sectional view of a golf club grip on a shaft.
Figure 2:
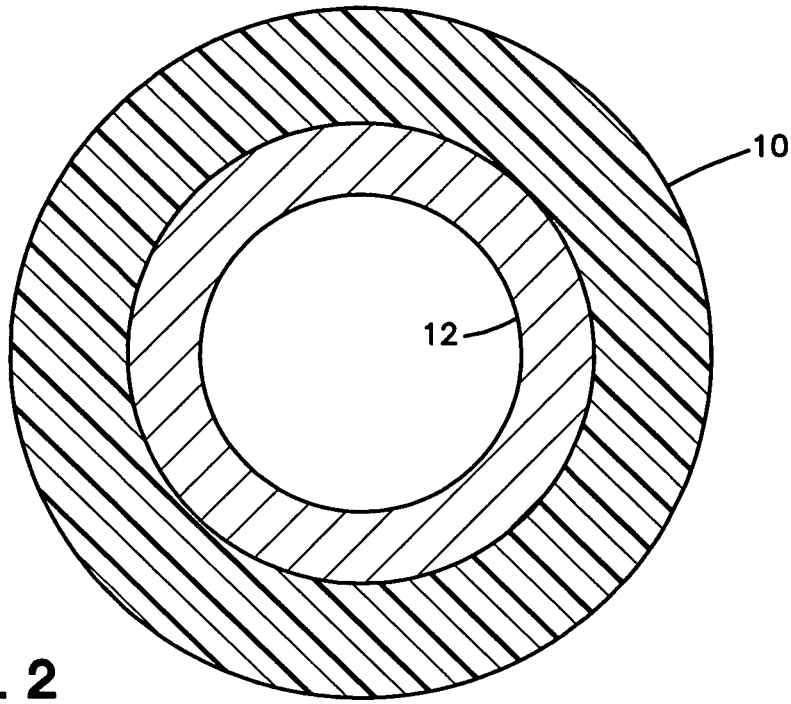
Fig. 2 PRIOR ART
FIG. 2 is a sectional view of the grip taken at lines 2-2.

Referring to the figures, which are not intended to limit the present disclosure and where like numerals designate like or similar features throughout the several views, and first in particular to FIG. 1, there is shown a sectional view of a golf club grip 10 positioned on a golf club shaft 12. While the present disclosure finds specific utility to golf club grips and will be described in reference thereto, it should be understood that the present disclosure should not be construed to as being limited to only golf club grips. The present disclosure is equally applicable to any hand grip. Golf club grip club 10 is what is known in the art as a slip-on style golf club grip. The term "slip-on" as employed herein is intended to refer to a grip that is designed to slide onto a handle or shaft 12 and be secured with a double sided adhesive tape or other suitable method. As seen in FIG. 2, grip 10 is substantially circular and mounted with its interior wall proximate shaft 12 so as to maintain its fairly circular shape.

Some individuals prefer to have a reference on a grip in a location that allows one to quickly hold the grip in a manner that is familiar to them for a given task. For a golfer, this rib is located on the underside or back of the grip. The United States Golf Association ("U.S.G.A.") and the current Rules of Golf has a set of rules for golf that requires grips on any golf clubs other than putters to be circular in cross-section. This rule does create an exception in that a continuous, straight, slightly raised rib on the back of the grip may be incorporated along substantially the full length of the grip. This rib is often referred to as a "reminder" rib. The reminder rib assists the golfer in quickly identifying hand position on the grip as well as proper positioning of the hands for the grip. The rules of golf interpret the term "slightly raised" as meaning that the maximum and minimum diameters of the cross-section at any point of the grip must not differ by more than about 0.04 inches or about 1 millimeter (mm) for these types of golf grips. As stated in the golf rules, this measurement is taken using a pair of calipers, laser micrometer, or other similar device. A standard length golf grip is approximately 254 mm in length and the term "full length of the grip" is interpreted to mean that the rib must extend to within approximately 76 mm of the tip. This is the portion of the golf grip closest to the club face. This is considered sufficient to cover the span of a golfer's hand on the grip.

Figure 3:
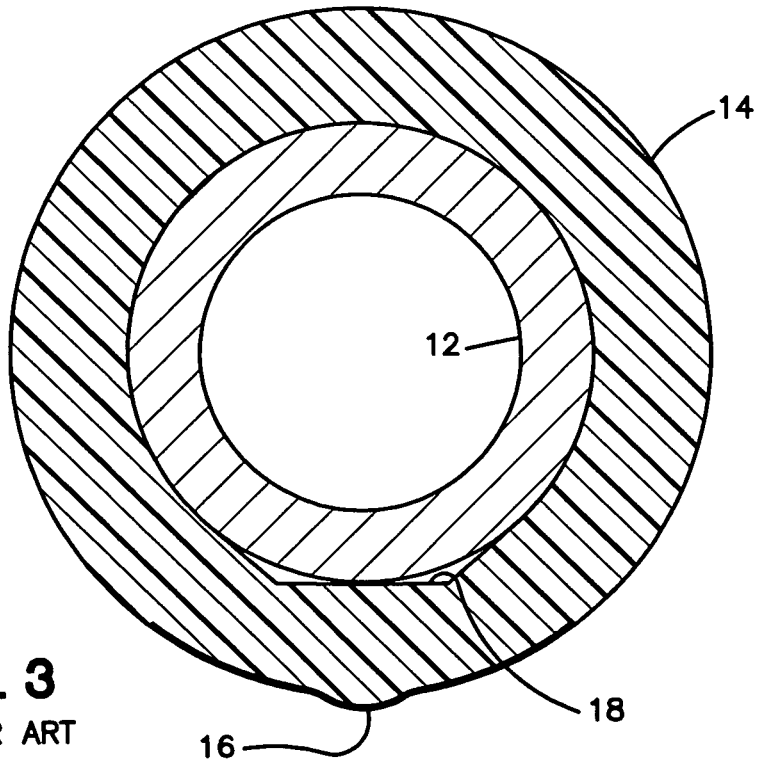
Fig. 3 PRIOR ART
FIG. 3 is a sectional view of a prior art grip used to form a reminder rib.

FIG. 3 depicts in cross sectional view a prior art grip 14 used to form a reminder rib 16. A flat portion 18 was molded into the grip 14. When grip 14 is placed on a shaft 12, the flat portion 18 causes that portion to bulge out forming the reminder rib 16.

Depending upon the durometer of the grip material and the thickness of the cross section of the grip, these changes can affect the height of the reminder rib as the grip tapers down the golf shaft. The reminder rib height varies as well as the width of the resulting surface bulge of the sides of the reminder rib. This means the wider the base the higher the reminder rib is in height, but the wider the width of the bulge section. Thus, the resulting feel of the reminder rib can become diminished to the golfer.

To function correctly the reminder rib should be fairly parallel to the axis of the shaft at all times and be fairly normal on the center of the back of the shaft and grip although a plus or minus of approximately five degrees to ten degrees may still be usable or even preferable to some golfers. Therefore, location is difficult to control quickly and consistently in making a grip and in positioning the grip correctly on the shaft.

Figure 4:
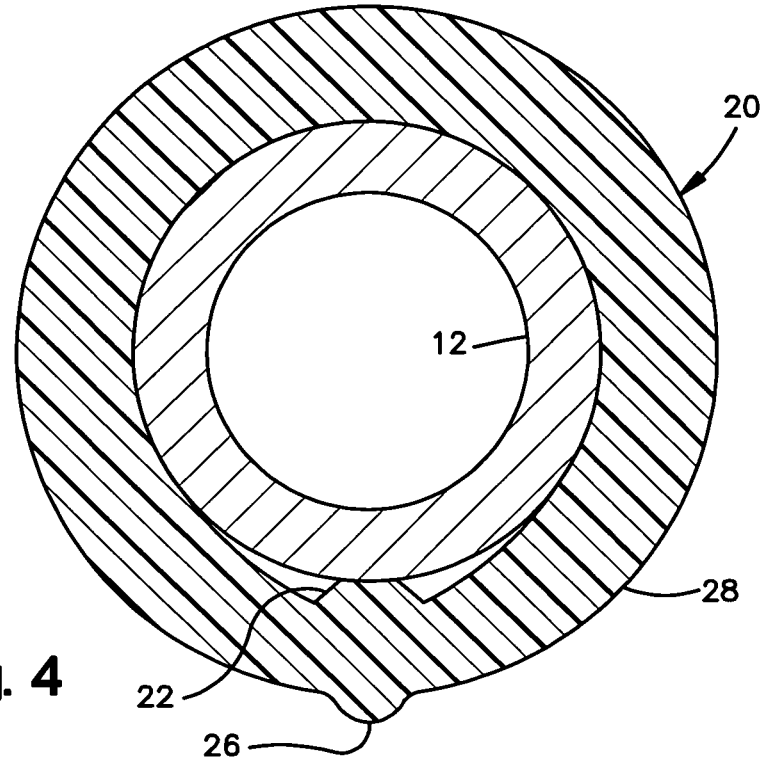
FIG. 4 is a sectional view a golf club grip formed with the present disclosure mounted on the shaft.
Figure 5:
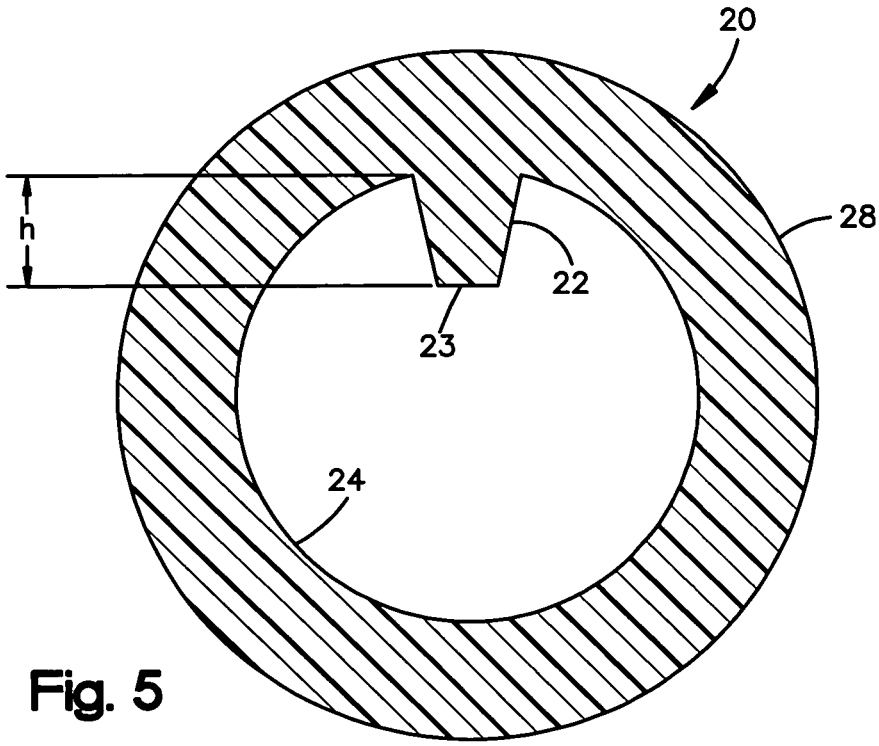
FIG. 5 is a sectional view of a golf club grip formed with the present disclosure.
Figure 6:
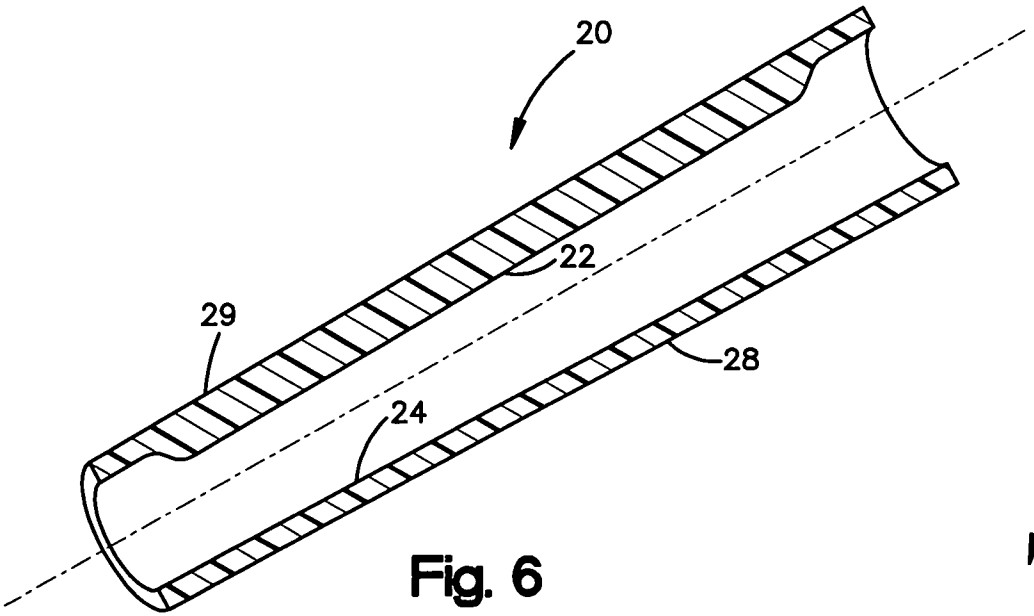
FIG. 6 is an axial cross sectional view of a portion of the golf club grip formed with the present disclosure.

As shown in FIGS. 4-6, the present disclosure forms a grip 20 with a rib 22 extending on an interior surface 24 of grip 20. When the grip 20 is mounted on a shaft 12 as seen in FIG. 4, the interior rib 22 causes a reminder rib 26 to form, by bulging outwards, on the outer surface 28 of the grip. As previously mentioned, the height of a reminder rib in order to comply with U.S.G.A. rules must be equal to or less than approximately 1 millimeter. Consequently, the height h of interior rib 22 is selected so that when the grip 20 is mounted on the shaft 12 the reminder rib 26 does not exceed 1 mm in height.

While rib 22 in FIG. 5 is shown as a V-shaped rib with a flat bottom 23, it should be understood that rib 22 can have a more rounded form, like a hill, or be in the shape of a sharper V without a flat bottom. When grip 20 is correctly mounted on a golf club shaft 12, interior rib 22 causes the formation of the reminder rib 26. As seen in FIG. 6, interior rib 22 extends axially in a linear manner on the interior surface of the portion of the grip. The outside surface is intended for use as the underside or back side surface 29 of the grip 20.

Figure 7:
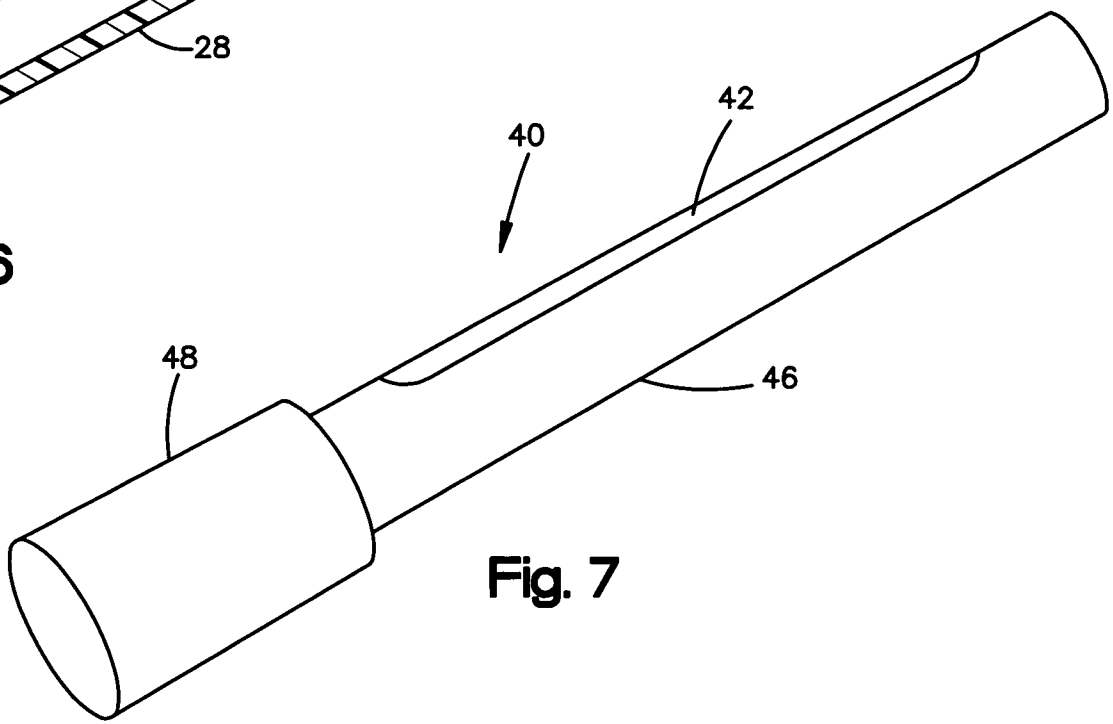
FIG. 7 is an elevated perspective view of one embodiment of the core bar.
Figure 8:
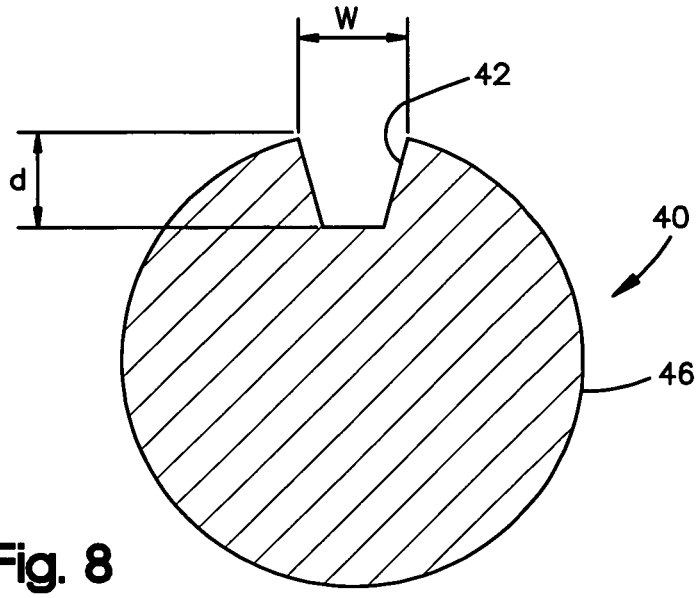
FIG. 8 is a cross sectional view of one embodiment of the core bar.

To form grip 20 with interior rib 22, an improved core bar 40 has an axial slot or groove 42 cut in the outer surface 44 over substantially the length of the core bar 40 as best seen in FIGS. 7 and 8. Core bar 40 is fairly cylindrical in structure and has a molding portion 46 and a handle portion 48. While a molding portion 46 of core bar 40 appears substantially cylindrical in FIG. 7, it should be understood that the molding portion 46 for a golf club grip may include a slight taper. Groove 42 in order to comply with the Rules of Golf must extend to within approximately 76 mm of the tip of the grip, that is, the end of the grip closest to the club face. A golf grip typically is approximately 254 mm in length so groove 42 can range in length from approximately 178 mm to approximately 254 mm. Of course, these ranges are being provided for illustrative purposes and are not intended to be limiting the present disclosure thereto.

Figure 9:
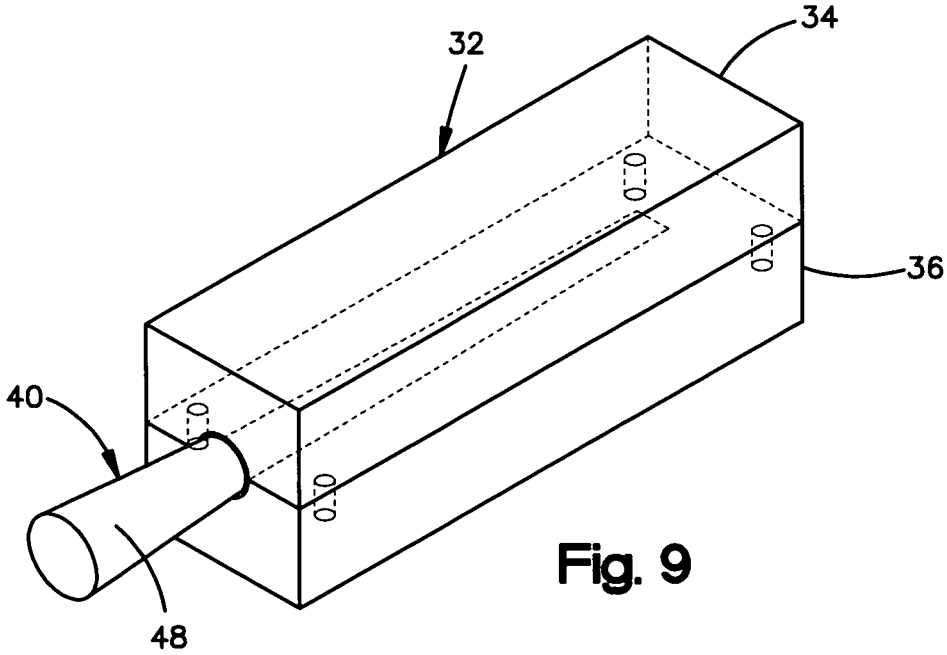
FIG. 9 is a compression mold suitable for use with the present disclosure showing the core bar within the mold.

The molding portion 46 of core bar 40 is positioned fairly centrally within a compression mold 32 as seen in FIG. 9. In an alternate embodiment, core bar 40 may be used with an injection mold. An elastomeric material is placed into the mold, for example trapezoidal shaped strips of elastomeric material, are placed in the upper and lower cavity sections 34, 36 in compression mold 32 and then heated at a temperature with a compressive force sufficient to join and vulcanize the elastomeric material to form a grip 20 with the interior rib 22. The core bar is situated in the mold so that the interior rib 22 is formed on the underside or back 29 of the grip 20. As used herein the term "elastomeric" material is intended to include but not be limited to rubber both natural and synthetic, silicone, or an elastomer, or any combinations thereof. Core bar 40 includes a handle portion 48 to facilitate insertion and removal of the core bar 40 from the mold. In the injection process, the elastomeric material may be introduced into the mold in liquid, pellet, or strip form.

Returning to FIG. 8, the size of the groove 42 will depend upon the selected elastomeric material and thickness of the cross-section of the grip. For illustrative purposes for a golf club grip, groove 42 has a width w that ranges from approximately 0.75 mm to approximately 4.70 mm, and a depth d that ranges from approximately 0.75 mm to approximately 2.54 mm. Groove 42 as seen in FIG. 7 includes a flat bottom 43 to create the flat bottom 23 of interior rib 22. As mentioned previously, other embodiments include any shape for groove 42 to form the corresponding shape for the interior rib 22. The improved core bar 40 with groove 42 allows for more control in making an interior rib that as a result allows for greater control in the design and formation of the reminder rib 26 when the grip 20 is installed on a shaft 12.

Figure 10:
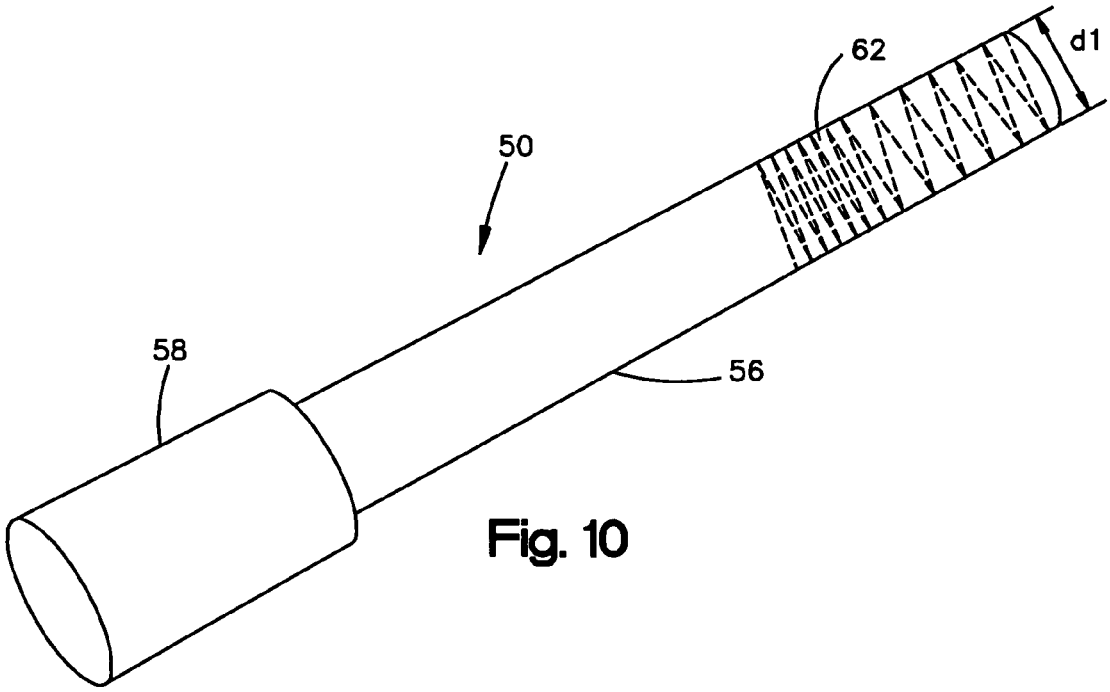
FIG. 10 is a view similar to FIG. 7 depicting an alternate embodiment.
Figure 11:
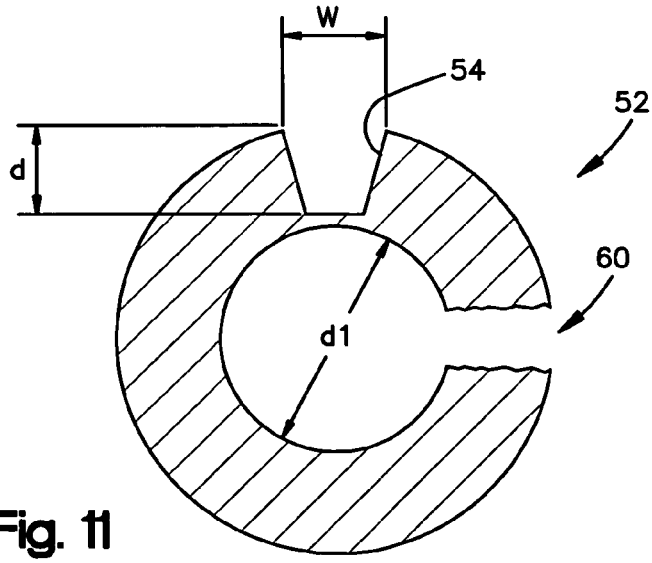
FIG. 11 is a view similar to FIG. 8 depicting an alternate embodiment.

FIGS. 10 and 11 depict an alternate embodiment of the core bar 50 in accordance with the present disclosure. Core bar 50 is structurally similar to core bar 40, but the molding portion 56 has a diameter d1 less than the diameter of the molding portion of core bar 40. The reduced diameter d1 of core bar 50 receives a sleeve 52 with a slot or groove 54 cut into the sleeve 52. Sleeve 52 is constructed to be removably attached to the molding portion 56 of the core bar 50 with a fastener, like a set screw for example, through one or more threaded openings 60. An alternate embodiment of sleeve 52 may include sleeve 52 being threadably received onto the molding portion 56 of core bar 50 as seen with the dashed threaded lines 62 on core bar 50. Core bar 50 includes a handle portion 58 and is used in the molding process in a similar manner to that previously described with respect to core bar 40. The feature of using a removable threaded sleeve 52 according to the present disclosure allows one core bar 50 to be used for forming a regular type of grip 10 as shown in FIGS. 1 and 2 with a sleeve that has no axial groove, and a grip 20 according to the present disclosure by using a sleeve 52. Groove 54 is cut into the sleeve 52 in a similar manner and form as previously described with respect to core bar 40.

Figure 12:
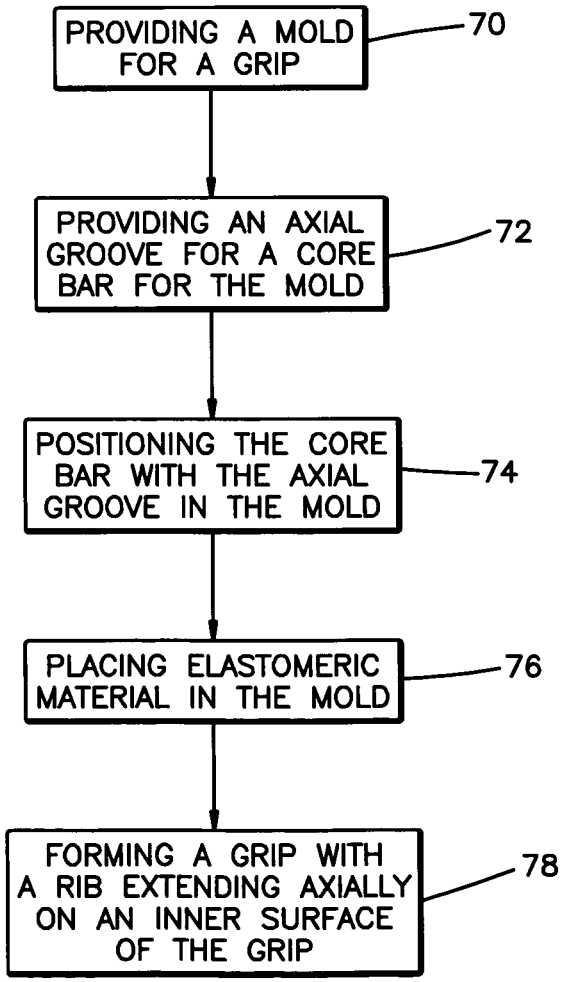
FIG. 12 is a process flow chart identifying the steps of the present disclosure.

FIG. 12 is a process flow chart identifying the steps of the present disclosure. The process begins with step 70 by providing a suitable mold for the grip. As mentioned earlier the mold may be a compression mold or an injection mold. In the next step 72, an axial groove is provided for a core bar to be used with the mold. The core bar is then positioned in the mold in step 74. Elastomeric material is placed in the mold in step 76. This step 76 in whole or in part may be performed prior to step 74. For example, in a compression molding process some of the elastomeric material may be placed in a lower section 36 of the compression mold 32, and then the core bar 40, 50 is positioned thereon. Then, additional elastomeric material placed over the core bar 40, 50 and the mold is sealed with the upper section 34. An elastomeric material may also be placed in the mold by way of an injection molding process with the elastomeric material in pellet or liquid form to make the grip 20 with an interior rib 22 situated axially along an intended underside portion 29 of the grip. Step 78 forms the grip 20 with an interior rib 22 such that when the grip 20 is placed on a shaft 12 a reminder rib 26 is formed.

While specific embodiments of the disclosure have been shown and described in detail to illustrate the application of the principles of the disclosure, it will be understood that the disclosure may be embodied otherwise without departing from such principles.

The invention claimed is:

1. An improved mold for a golf grip, comprising an upper cavity section of a compression mold; a lower cavity section of a compression mold; and a core bar, said core bar being a fairly cylindrical structure having a handle portion and a portion for molding a golf grip, said molding portion constructed for placement within the cavity sections of the compression mold for receiving elastomeric material on an outer surface thereof, said molding portion having a groove having a selected length and depth extending axially in said molding portion on an outer surface thereof, said groove being situated at a location in said molding portion to provide a rib inside a golf grip; wherein said core bar includes a removable sleeve disposed over said molding portion of said core bar with said groove being disposed on said removable sleeve.

2. An improved mold as recited in claim 1, wherein said groove has a width w of approximately 0.75 mm to approximately 4.70 mm and a depth d ranging from approximately 0.75 mm to approximately 2.54 mm.

* * * * *